US007450078B2

(12) United States Patent
Knudsen et al.

(10) Patent No.: US 7,450,078 B2
(45) Date of Patent: Nov. 11, 2008

(54) LOOP ANTENNA FOR IN THE EAR AUDIO DEVICE

(75) Inventors: Ove Knudsen, Smørum (DK); Kåre Tais Christensen, Smørum (DK)

(73) Assignee: Oticon A/S, Smorum (DK)

( * ) Notice: Subject to any disclaimer, the term of this patent is extended or adjusted under 35 U.S.C. 154(b) by 0 days.

(21) Appl. No.: 11/657,447

(22) Filed: Jan. 25, 2007

(65) Prior Publication Data

US 2007/0188402 A1 Aug. 16, 2007

(30) Foreign Application Priority Data

Feb. 15, 2006 (EP) ..... 06 101 703

(51) Int. Cl.
*H01Q 7/00* (2006.01)

(52) U.S. Cl. ..... 343/718; 343/702; 343/741

(58) Field of Classification Search ..... 343/702, 343/718, 741, 742, 866, 867
See application file for complete search history.

(56) References Cited

U.S. PATENT DOCUMENTS 5,734,976 A 3/1998 Bartschi et al.
6,537,200 B2 * 3/2003 Leysieffer et al. ..... 600/25
6,591,786 B1 * 7/2003 Davis ..... 119/719
2002/0030630 A1 3/2002 Maeda et al.
2003/0025478 A1 2/2003 Zinc et al.
2004/0028251 A1 2/2004 Kasztelan et al.

FOREIGN PATENT DOCUMENTS

DE 10 2004 021 962 A1 6/2005
EP 1 389 035 A2 2/2004
WO WO-2005/081583 A1 9/2005

* cited by examiner

*Primary Examiner*—Tho G Phan
(74) *Attorney, Agent, or Firm*—Birch, Stewart, Kolasch & Birch, LLP

(57) ABSTRACT

The invention regards a communication device which is adapted for placement in a users ear and comprises a shell part enclosing an input transducer for receiving an input signal, a signal processing device and an output transducer for providing a signal perceivable as sound, a battery located at a surface part of the shell which is facing away from the head of the user, a transmission and reception circuit for transmission and/or reception of electromagnetic energy, and where an antenna for radiating and/or receiving electromagnetic energy is arranged with a first surface turned towards the surroundings and a second surface located in close proximity of the battery whereby the antenna forms a loop with a loop axis pointing away from the ear and head, whereby the loop material has a wider extension in the direction of the loop axis than in the direction perpendicular to the loop axis.

7 Claims, 3 Drawing Sheets

LOOP ANTENNA FOR IN THE EAR AUDIO DEVICE

AREA OF THE INVENTION

The invention regards a loop aerial or antenna for an in the ear audio device. There are two measures which have major impact on the efficiency and bandwidth of loop antennas. These measures are the area surrounded by the loop and the cross section of the conductor forming the loop. The area determines the efficiency and the cross section determines the reactive part and bandwidth of the antenna impedance.

BACKGROUND OF THE INVENTION

It is common knowledge that electrically small antennas exhibit high quality factors and small bandwidths i.e. the bandwidth follows size. In prior art publication WO 2005081583 A1 a small loop antenna is disclosed wherein the antenna is made of a conducting strip lying in the same plane as the outer surface of the battery drawer of a hearing aid. The prior art antenna has limited bandwidth, a problem, which is hard to overcome given the space limitations of an ITE hearing aid.

The present invention provides means to increase the bandwidth of the antenna whereby the given space for accommodating an antenna is used more efficiently.

The general idea of the invention is to increase the area surrounded by the loop while maintaining the cross section and the outer circumference of the loop.

The invention covers an electrically small loop antenna with increased bandwidth and efficiency for ITE and CIC. However other kinds of audio equipment for use in the ear may benefit from the invention. This could be sound protectors or wireless communication devises used in the ear.

SUMMARY OF THE INVENTION

This is achieved by transforming the two dimensional plane micro strip loop structure into a three dimensional structure with the broad side of the strip raised orthogonally to the loop plane and following the outer circumference of the original loop.

According to claim 1 the invention comprises a communication device which is adapted for placement in a user's ear. The device comprises a shell part enclosing an input transducer for receiving an input signal, a signal processing device and an output transducer for providing a signal perceivable as sound, a battery located at a surface part of the shell which is facing away from the head of the user, a transmission and reception circuit for transmission and/or reception of electromagnetic energy. Further an antenna for radiating and/or receiving electromagnetic energy is arranged with a first surface turned towards the surroundings and a second surface located in close proximity of the battery whereby the antenna forms a loop with a loop axis pointing away from the ear and head. According to the invention the loop material has a wider extension in the direction of the loop axis than in the direction perpendicular to the loop axis.

The area originally covered by the width of the strip is then turned into active loop area while the cross section of the strip is kept constant which is necessary to keep the inductance low. A thin wire would increase the inductance and lower bandwidth considerably. The extra volume occupied by an upright strip is actually available in the mechanical structure around the battery drawer of the current design of ITE and CIC hearing aids.

The invention covers an electrically small loop antenna with increased bandwidth and efficiency for ITE and CIC hearing aids made of a conducting strip with the broadside of the strip facing the centre of the loop.

According to an embodiment of the invention the loop is an open loop.

In a further embodiment the loop is part of the battery drawer. In this way the placement of the loop in relation to the battery will be the same for all the communication devices with an antenna according to the invention.

In a further embodiment the loop is part of a housing of the communication device. In some instances it may be advantageous to build the loop into the housing structure, whereby the battery drawer may be made with slightly smaller dimensions.

Preferably the loop material has a thickness in the direction perpendicular to the loop axis of about 0.01 to 0.15 mm. These dimensions allow the loop to be made with a variety of different processes, and at the same time the requirement for the size of the loop in order to gain sufficient cross sectional material is not excessive.

Preferably the loop follows the circumference of a battery because most constructions have sufficient spare room for the antenna around the battery.

Preferably the loop area is as large as possible and no less than 45 $mm^2$. This allows a reasonable antenna efficiency.

DESCRIPTION OF A PREFERRED EMBODIMENT

Figure 1:
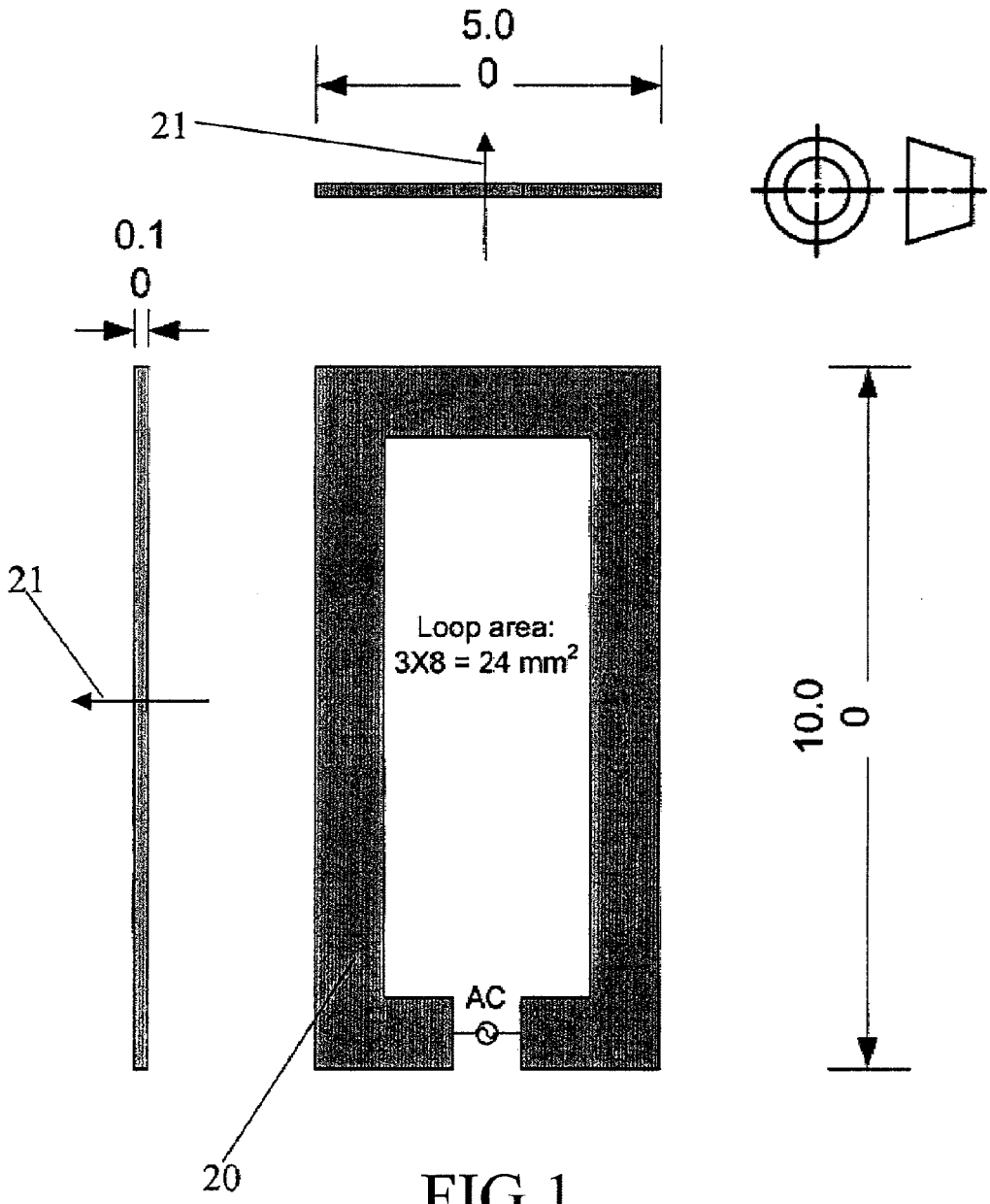
FIG.1 PRIOR ART
FIG. 1 is a drawing of a prior art antenna.

FIG. 1 shows a prior art antenna where a square loop 20 with an open area compatible with the size of a battery drawer of an ITE or CIC hearing aid is arranged with the loop material extending in the plane of the outer surface of the battery drawer and orthogonally to the loop axis. This loop will have a loop area of 24 $mm^2$. The loop axis is defined by arrow 21. The thickness of the loop material is 0.1 mm in the direction of the loop axis 21. The loop material extends primarily perpendicular to the loop axis 21. The product A, of the extension of the loop material in the direction of the loop axis 21 and the extension of the loop material perpendicular to the loop axis 21 is inversely proportional with the reactive part of the antenna impedance, and this part of the impedance should not be increased. The size of the product A should thus preferably not be any smaller when changes in the loop antenna are made.

Figure 2:
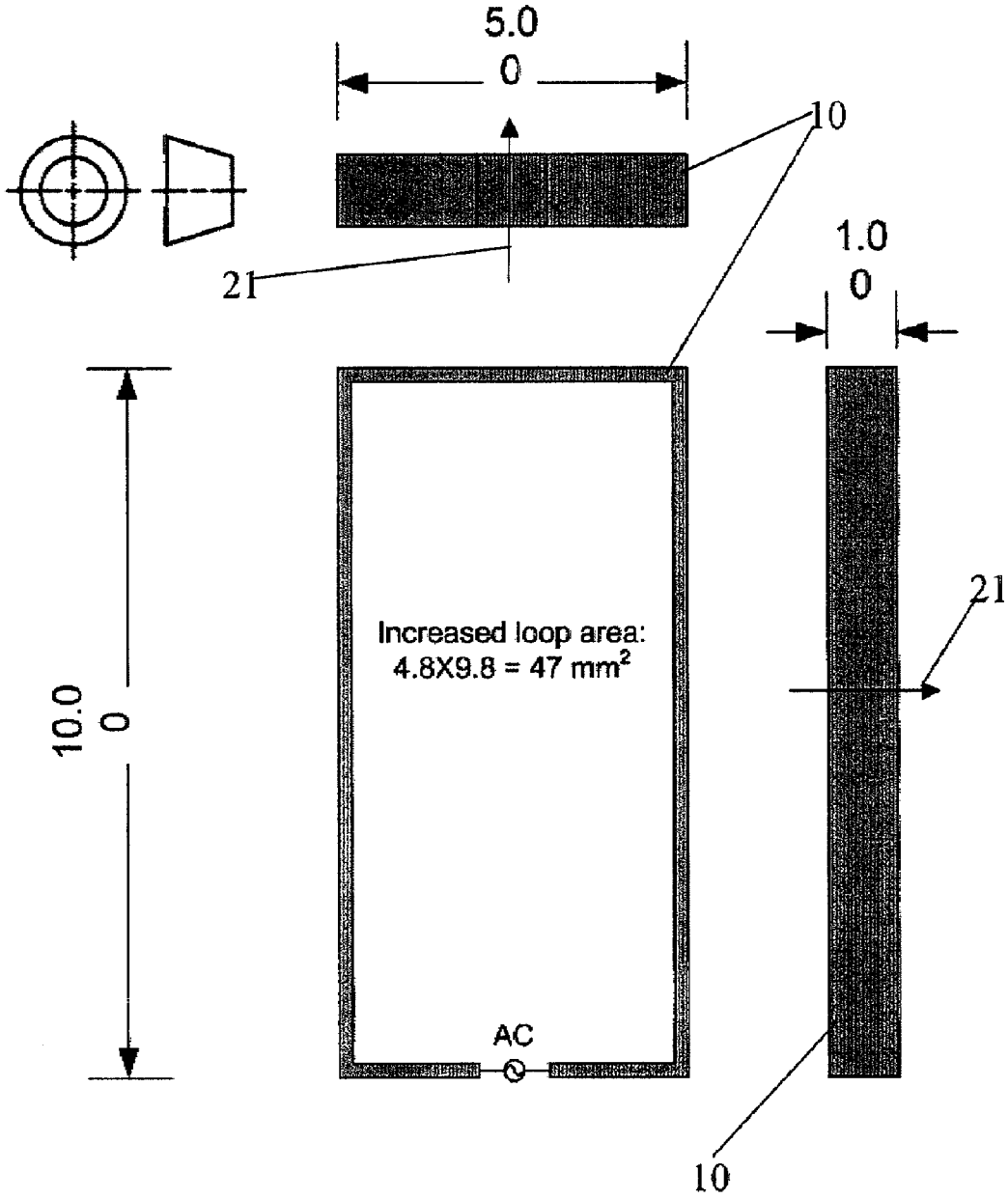
FIG. 2 is a drawing of the antenna according to an embodiment of the invention.

In FIG. 2 the improvement achieved by the invention is visible. Here the area of the loop is 47 $mm^2$ which is almost the double area of the prior art loop. This is achieved without sacrificing bandwidth and without enlarging the outer dimensions. The thickness of the material is still 0.1 nm but this is now perpendicular to the loop axis 21. The extension of the material in the direction of the loop axis is now large. Thus the antenna is constructed to use the free empty space in the 3rd dimension along the sides of the battery and the loop in FIG. 2 has the same outer perimeter as the prior art loop shown in FIG. 1 and the same cross sectional area A. Possibly the loop is integrated in the structure and constitute a part of the battery drawer.

Figure 3:
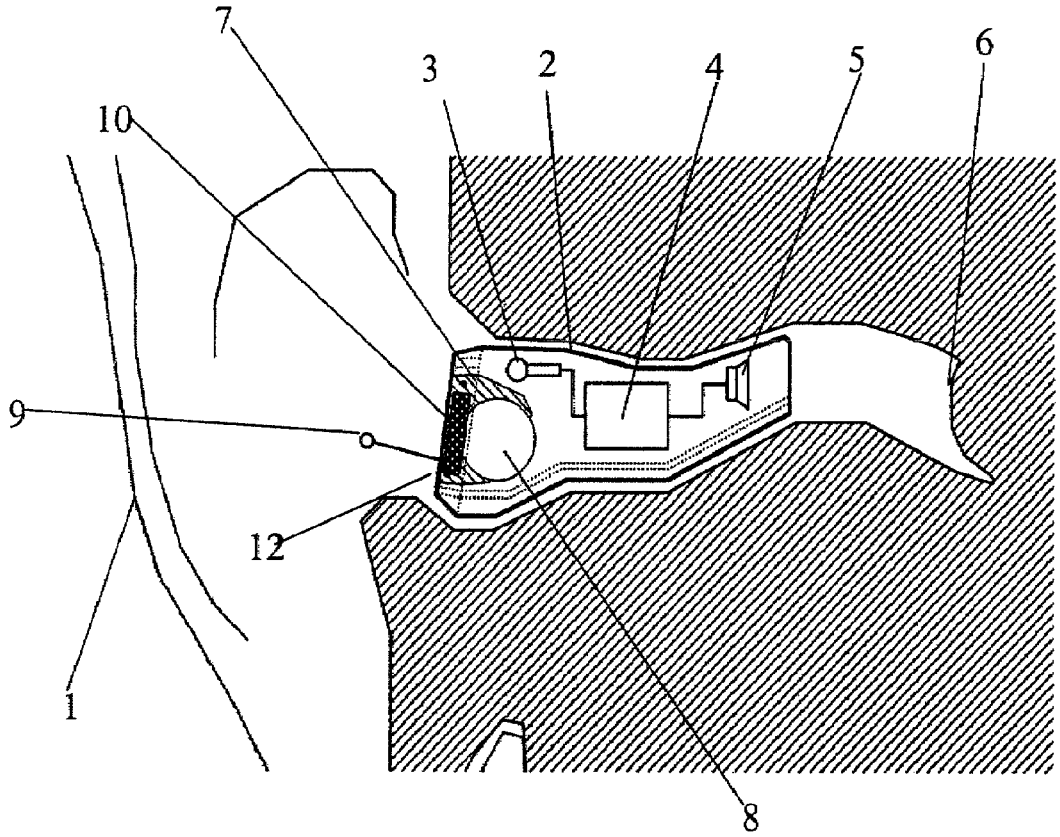
FIG. 3 is a schematic sectional view of a hearing aid with the antenna according to the invention.

In FIG. 3 a schematic sectional representation of a CIC hearing aid is shown with an antenna according to the invention. The hearing aid comprises a custom made shell part 2 which is placed deep in the ear canal. Instead of being custom made the shell part can be either flexible or have a flexible outer portion which allows it to be inserted into the ear. 1 is an outline of the external ear of a person. The shell part 2 encloses a receiver 5, a signal processing unit 4 and a microphone 3. The receiver 5 is arranged with an output orifice (not shown) close to the tympanic membrane 6 in order to deliver a useful audio signal to the user. A front plate part 12 is arranged to face the surroundings. In this part a battery drawer 7 with a battery 8 is placed. Also an extractor 9 may be comprised in the front plate 12. Other components may be placed in the shell 2 or associated with the front plate part 12, such as further microphones or connectors for wired contact with other equipment like telephones. Also the hearing aid will comprise a transmission and/or reception circuit in order to feed/receive electromagnetic energy to/from the antenna. This circuit is connected to the antenna and to the signal processing part 4. The transmission and/or reception circuit is not shown in the figures, and it may be configured as an independent circuit part or it can be configured as part of the signal processing part 4.

An antenna 10 is schematically shown in FIG. 3. The antenna 10 is placed in the area between the battery and the external surface of the frontal plate. The antenna 10 may either be provided as a part of the battery drawer 7 or it may be integrated into the front plate part 12 and hereby come to surround the battery drawer 7. In either case the antenna 10 is provided as a narrow metal band which forms a loop.

The invention claimed is:

1. Communication device which is adapted for placement in a users ear and comprises a shell part enclosing an input transducer for receiving an input signal, a signal processing device and an output transducer for providing a signal perceivable as sound, a battery located at a surface part of the shell which is facing away from the head of the user, a transmission and reception circuit for transmission and/or reception of electromagnetic energy, and where an antenna for radiating and/or receiving electromagnetic energy is arranged with a first surface turned towards the surroundings and a second surface located in close proximity of the battery whereby the antenna forms a loop with a loop axis pointing away from the ear and head, whereby the loop material has a wider extension in the direction of the loop axis than in the direction perpendicular to the loop axis.

2. Communication device as claimed in claim 1, wherein the loop is an open loop.

3. Communication device as claimed in claim 1, wherein the loop is part of the battery drawer.

4. Communication device as claimed in claim 1, wherein the loop is part of a housing of the communication device.

5. Communication device as claimed in any of the above claims, wherein the loop material has a thickness in the direction perpendicular to the loop axis between 0.15 mm and 0.01 mm.

6. Communication device as claimed in claim 1 wherein the loop follows the circumference of a battery.

7. Communication device as claimed in claim 1 wherein the loop area is no less than 45 $mm^2$.

* * * * *